US008602253B2

(12) United States Patent
Beltrante

(10) Patent No.: US 8,602,253 B2
(45) Date of Patent: Dec. 10, 2013

(54) KEG CUP HOLDER

(76) Inventor: Joseph Beltrante, Delanco, NJ (US)

( * ) Notice: Subject to any disclaimer, the term of this patent is extended or adjusted under 35 U.S.C. 154(b) by 146 days.

(21) Appl. No.: 13/317,086

(22) Filed: Oct. 7, 2011

(65) Prior Publication Data

US 2012/0118902 A1 May 17, 2012

Related U.S. Application Data

(60) Provisional application No. 61/414,204, filed on Nov. 16, 2010.

(51) Int. Cl.
*B65D 21/02* (2006.01)

(52) U.S. Cl.
USPC ..... 220/738; 220/739; 220/6

(58) Field of Classification Search
USPC ..... 220/6, 737, 738, 507, 694, 729, 735, 220/890; 248/311.2
See application file for complete search history.

(56) References Cited

U.S. PATENT DOCUMENTS

| | | | | |
|---|---|---|---|---|
| 5,551,558 | A * | 9/1996 | Bureau | 206/223 |
| 6,202,874 | B1 * | 3/2001 | Diamond | 220/4.03 |
| 2009/0260546 | A1 * | 10/2009 | George et al. | 108/26 |

* cited by examiner

*Primary Examiner* — Stephen Castellano
(74) *Attorney, Agent, or Firm* — Stuart M. Goldstein

(57) ABSTRACT

A keg cup holder has a plurality of cup holder openings, each encircling a recessed cup support, for securely holding cups in place on top of a beer keg. A through opening in the center is provided to allow the keg pump and dispenser tube/handle to extend vertically above the keg cup holder, so as to allow for its free operation. A side wall is sized to allow the keg cup holder to fit atop standard barrel kegs. Support members extend downward from the side wall to prevent the keg cup holder from shifting and to provide added stability. To facilitate portability, the keg cup holder is preferably constructed of an inexpensive and lightweight yet robust material. In one embodiment, it may be folded into a compact position for moving and storage. A handle may be attached to the center support member.

17 Claims, 5 Drawing Sheets

KEG CUP HOLDER

RELATED APPLICATION

This application claims the benefit of provisional application Ser. No. 61/414,204 filed on Nov. 16, 2010.

FIELD OF THE INVENTION

The present invention relates to party accessories and particularly to a device for conveniently holding cups while filling them with consumable liquid from a keg, or for temporarily storing filled cups or a keg.

BACKGROUND OF THE INVENTION

Beer is an enormously popular drink both domestically and internationally. Consumers often buy beer in kegs when hosting parties where a large number of attendees are expected. Purchasing beer in kegs brings down the overall cost of the beer because, due to efficiency advantages over canning or bottling, the cost per volume is lowered, with such savings passed on to the consumer. Further, pouring beer from kegs is the most convenient dispensing method when large volumes are being consumed by many individuals.

There are two standard size beer kegs. A full keg is often referred to as a "half barrel" and holds approximately fifteen and one half gallons, while a "quarter-barrel" holds approximately seven and three quarter gallons. In either case, the consumer typically purchases a full keg from a beer distributor and places the keg in a bucket of ice to keep it cool until the beer is consumed. A tap is inserted into the top of the keg. The tap routinely comprises a pressurization pump and a dispensing handle/tube. The keg is pressurized by activating the pump, typically by moving the vertical pump lever up and down repeatedly as necessary, to obtain the desired rate of beer flow from the keg. The dispensing tube is also connected to the tap on the top of the keg. A lever on the dispensing handle is held open to dispense the beer into a cup for individual consumption.

While certain aspects of the keg make it convenient for parties, there is a common problem with the dispensing operation. Specifically, there is no suitable location for storing cups that have been filled with beer. Party hosts or guests often aspire to keep several freshly filled glasses of beer available for others to partake of at any convenient time. It is not uncommon for those pouring beer to then place filled glasses on top of the keg along the vertical "lip" or rim on the top of the keg. Unfortunately, this is a very unstable method of storing liquid-filled glasses, because the top of most kegs is domed rather than flat. Glasses placed on the keg will sit at an angle and thus can easily topple over. Moreover, glasses can slide side-to-side, leading to further instability. The inevitable outcome of such instability is that beer is inadvertently spilled and wasted, with the resulting mess.

A few prior art references have addressed certain needs pertaining to beer kegs and cup storage, but none have addressed the problem solved by the present invention. For instance, U.S. Pat. No. 6,082,896 discloses a sleeve for supporting a stack of cups on the side of the container and U.S. Pat. No. 6,729,758 references a pocket for holding cups. U.S. Pat. No. 6,783,034 describes a single cup holder positioned under a dispensing valve for holding only one cup at a time or a pressurized container. It is compatible for use with a standard keg. While these references describe convenient means to transport and hold a stack of cups, they do not securely hold and store a plurality of individual cups while dispensing a liquid beverage. U.S. Pat. No. Des. 412,348 shows a keg game table design. This device appears to be somewhat cumbersome and not readily adapted for use in securing and stabilizing beer glasses or mugs being filled or resting on standard shaped kegs.

SUMMARY OF THE INVENTION

It is thus the object of the present invention to overcome the limitations and disadvantages of prior keg cup holder devices by providing a keg cup holder which is not only readily adaptable to standard half or quarter kegs, but also reliably maintains the position of beer cups and glasses while one or multiple drinks are poured from the keg. Multiple secure locations in the holder allow cups to be held liquid-full without fear that they will tip over. The holder attaches securely to the keg to maintain the stability of the cups it holds.

An added object of the keg cup holder of the invention is its use in advertising, particularly given its visibility to a highly significant target audience of beer drinkers. The keg cup holder can be used for displaying discrete advertisement for local and national companies, including breweries, local distributors, and the like.

The present invention is also preferably lightweight to allow for easy portability when not in use. It is anticipated that the holder will be manufactured from a wide range of materials, including but not limited to, plastic, foam, rubber, or inflatable material. As such, it will be durable and easy to clean and store.

These and other objects are accomplished by the present invention, a keg cup holder having a plurality of cup holder openings, each encircling a recessed cup support, for securely holding cups in place on top of a beer or similar consumable beverage keg. A through opening in the center is provided to allow the keg pump and dispenser tube/handle to extend vertically above the top of the keg cup holder, so as to allow for its free operation. A side wall is provided and appropriately sized to allow the keg cup holder to fit atop a standard half or quarter barrel keg. Support members extend downward from the side wall to prevent the keg cup holder from shifting side-to-side and to provide added stability. To facilitate portability, the keg cup holder is preferably constructed of an inexpensive and lightweight yet robust material. In one embodiment, it may be neatly folded into a relatively compact position for moving and storage. A handle may be attached to the center support member to further facilitate carrying of the holder.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
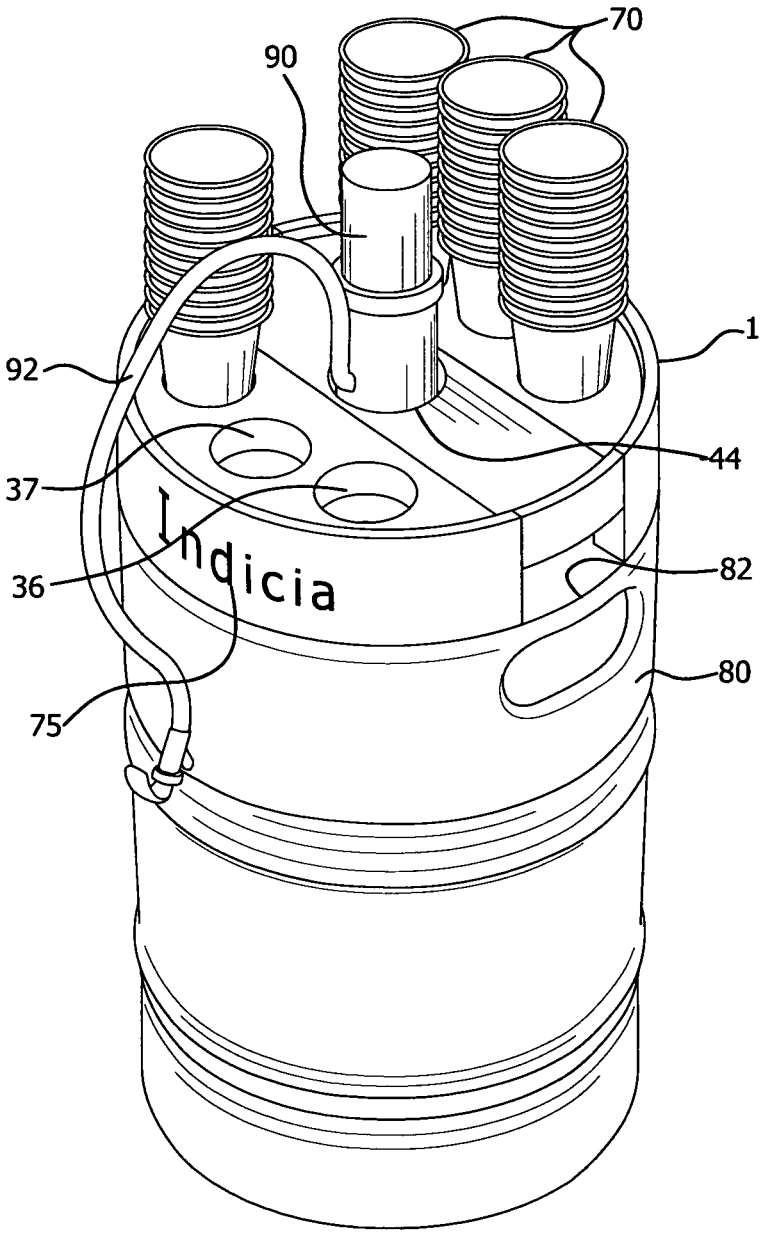
FIG. 1 is a perspective view of the keg cup holder of the present invention in use on a keg container.
Figure 2:
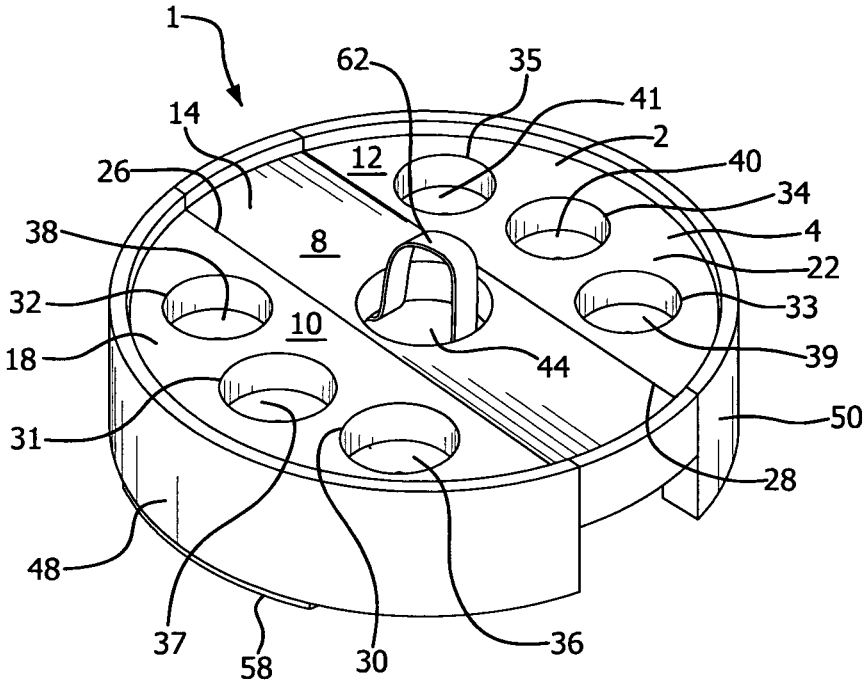
FIG. 2 is a top isometric view of the keg cup holder of the present invention.
Figure 4:
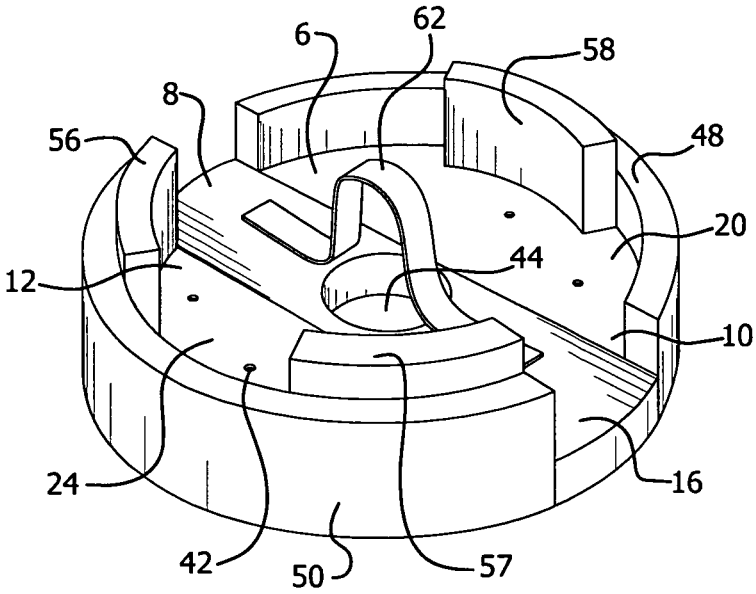
FIG. 4 is a bottom isometric view of the keg cup holder of the present invention shown in FIG. 2.

Keg cup holder 1 comprises top wall member 2 having top surface 4 and bottom surface 6. As best shown in FIG. 2, top wall member 2 comprises center wall member 8 and lateral wall members 10 and 12. Center wall member 8 has top surface 14 and bottom surface 16. Lateral wall member 10 has top surface 18 and bottom surface 20 and lateral wall member 12 has top surface 22 and bottom surface 24. Seams or hinges 26 and 28 allow lateral wall members 10 and 12 to rotate between two primary positions. Hinges 26 and 28 are made of flexible, yet strong material such as high strength plastic or fabric, or can comprise more mechanical hinges, known in the art. In the first, or use position, shown in FIGS. 1, 2, and 4, lateral wall members 10 and 12 are located in the same transverse plane as center wall member 8, so as to form completely flat, co-planar, continuously extending top surface 4, comprising top surfaces 14, 18 and 22.

Figure 5:
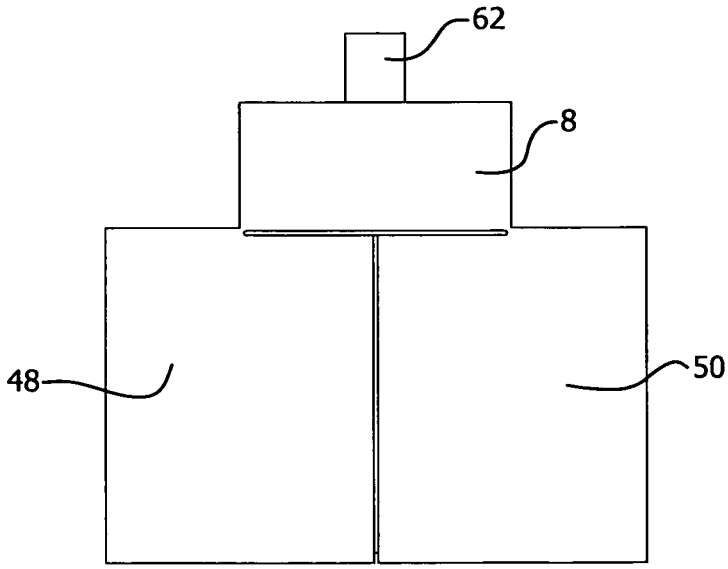
FIG. 5 is a side view of the keg cup holder of the present invention shown in FIG. 2 in its fully collapsed position.
Figure 7:
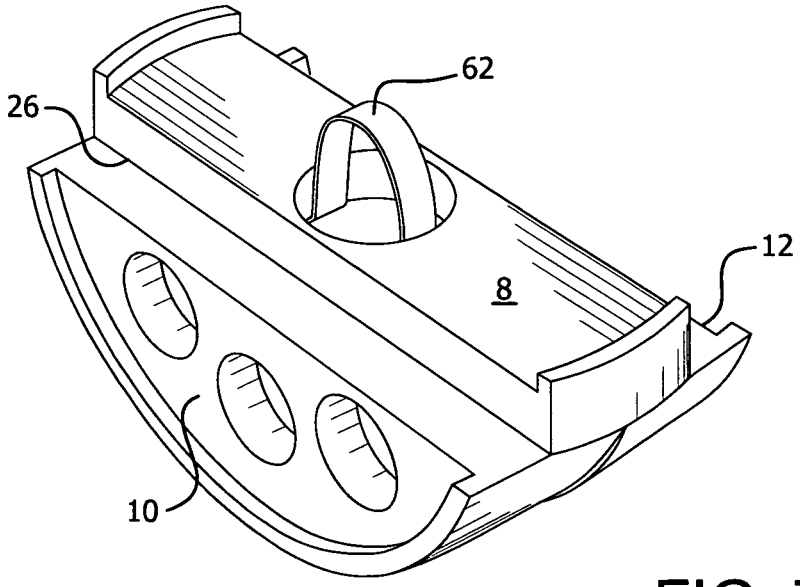
FIG. 7 is a top isometric view of the keg cup holder of the present invention shown in FIG. 2 in its fully collapsed position, ready to be transported.
Figure 8:
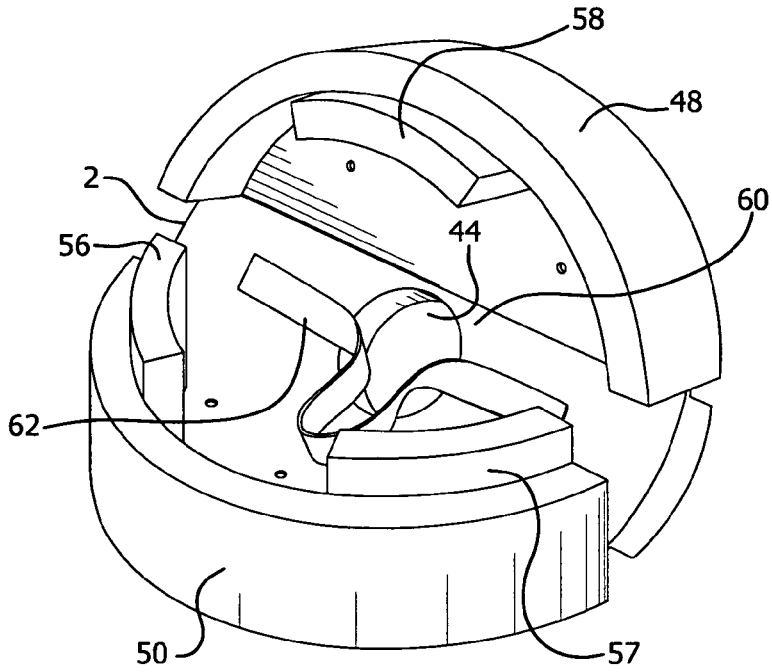
FIG. 8 is a bottom isometric view of the keg cup holder of the present invention shown in FIG. 2 in the process of being rotated to its collapsed position.

Lateral wall members 10 and 12 can be rotated down from the use mode or position to a second, transporting/storage collapsed mode or position, shown in FIGS. 5 and 7, in which the lateral members hang substantially perpendicular to center wall member 8. Hinges 26 and 28 ensure that lateral wall members 10 and 12 are freely rotatable between the two positions.

Openings 30, 31, 32, 33, 34 and 35 extend within and through top surfaces 18 and 22 of lateral wall members 10 and 12. The openings encircle and lead into recesses 36, 37, 38, 39, 40 and 41, which each extend between top surfaces 18 and 22 and bottom surfaces 20 and 24. The recesses are sized to accept cups, glasses, and equivalent drinking containers 70. Drain holes, e.g. as shown at 42, are provided beneath each recess and through bottom surfaces 20 and 24.

Figure 6:
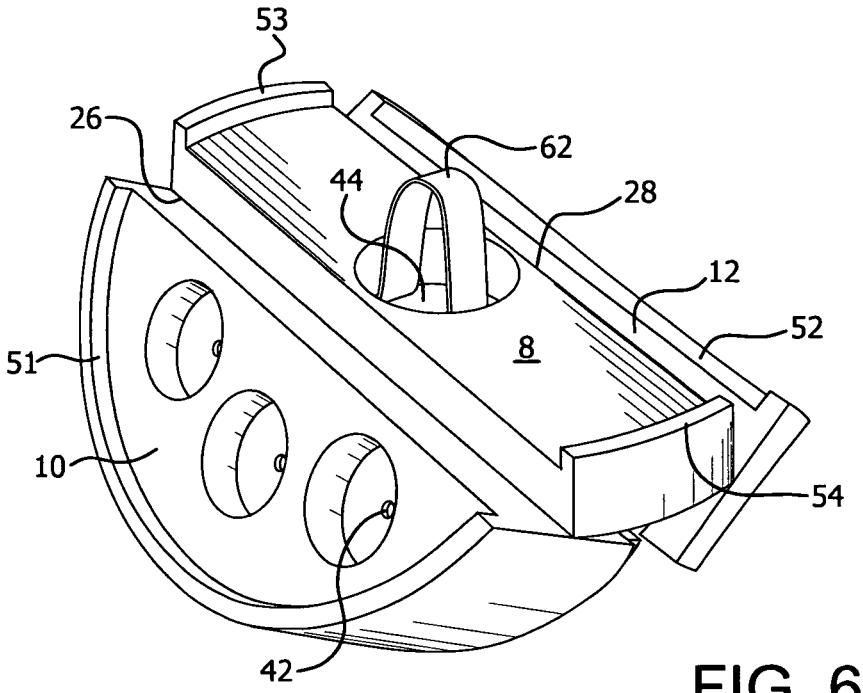
FIG. 6 is a top isometric view of the keg cup holder of the present invention shown in FIG. 2 in the process of being rotated to its collapsed position.

Opening 44 extends completely through the center of center wall member 8. Side wall, comprising side wall sections 48 and 50, extends down from and substantially circumscribes top wall member 2. See FIGS. 2 and 4. Rim, comprising rim sections 51, 52, 53, and 54, circumscribes and is located above lateral wall members 10 and 12 and center wall member 8. See FIG. 6. Support members 56, 57, and 58 extend down from lateral wall members 10 and 12. Open space 60 is formed in the area below top wall member 2, and within side wall sections 48 and 50. Handle 62 is optimally secured to bottom surface 16 and, when keg cup holder 1 is to be transported, extends through opening 44, as best shown in FIGS. 6 and 7.

In use, keg cup holder 1 is configured in its use position, such that, as previously described, lateral wall members 10 and 12 are within the same transverse plane as center wall member 8. Keg cup holder 1 is then positioned atop keg container 80, such that tap apparatus 90, with dispensing line 92, extends through opening 44. Support members 54, 56, and 58 rest on top of keg container 80 and, for most standard size keg containers, press snugly against the inside surfaces of rim 82 of the keg container. Keg cup holder 1 is thereby secured in a fixed, stable position on keg container 80. Beer or like drink can then easily be dispensed to cups or glasses 70, without threat of or actual spillage. Top surface 4 can also be utilized for placement of pitchers or other articles attendant to the dispensing operation.

Figure 9:
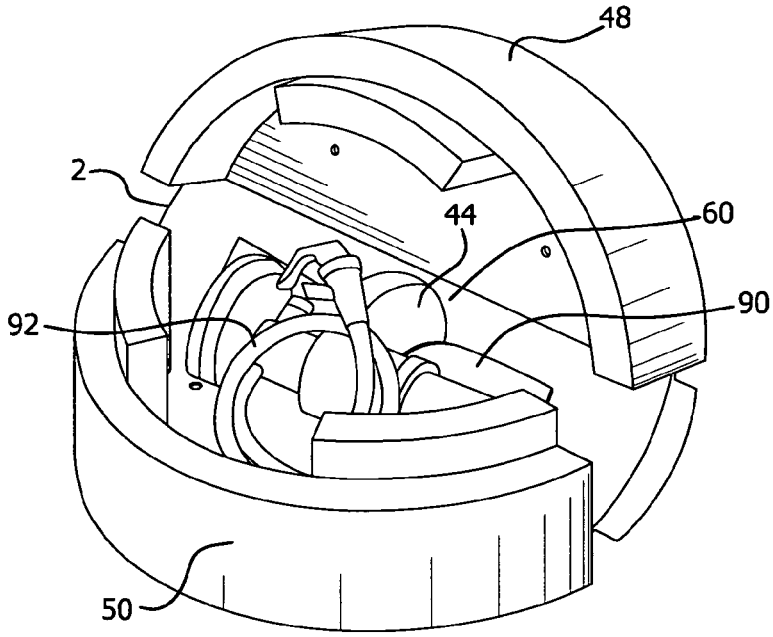
FIG. 9 is a bottom isometric view of the keg cup holder of the present invention shown in FIG. 2 with tap apparatus and dispensing means stored therein.

When keg container 80 is empty and/or is no longer to be used, keg cup holder 1 is simply removed from the keg container and its lateral wall members 10 and 12 are rotated down to its transport/storage collapsed position. See FIG. 7. Keg cup holder 1, being made of any number lightweight materials, e.g. plastic, foam, rubber, or their equivalents, is then easily transportable by means of handle 62. Open space 60 provides an available location to store tap apparatus 90 and dispensing line 92, once these are removed from keg container 80. See FIG. 9.

Keg cup holder 1 utilizes dual hinges 26 and 28 to accomplish its collapsed, transport ready position. However, it is contemplated that a single hinge, extending through the center or midline of the top wall, e.g. top wall 2, of a keg cup holder may be employed, in lieu of two side hinges. In this embodiment of the invention, the keg cup holder would fold down its middle, into two equally sized lateral wall members, for transport via its handle.

Figure 3:
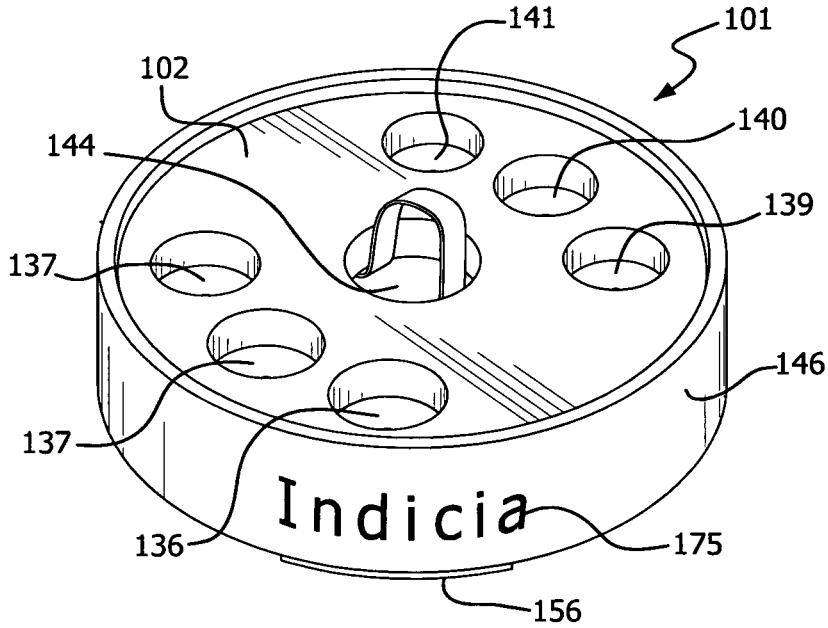
FIG. 3 is a top isometric view of an alternate embodiment of the keg cup holder of the present invention.

FIG. 3 shows an alternate embodiment of the invention in which top wall member 102 of keg cup holder 101 is not hinged and foldable, but is formed as a unitary member. Keg cup holder 101 still retains the advantageous features to ensure its secure and stable positioning atop a keg container and its effective use as a cup or glass holder. Keg cup holder 101 comprises recesses 136, 137, 138, 139, 140 and 141, sidewall 146, opening 144, and support members 156 and two others, not shown, but identical in configuration to the support members previously described.

The keg cup holder of the present invention has been described primarily with reference to beer kegs. However, any standard keg containing consumable beverages e.g. soda, juice etc., could benefit from the invention.

As has been described previously, printed advertisements 75 and 175 can be placed on side wall sections 48, 50 and 146 of keg cup holders 1 and 101, respectively. The keg cup holder itself could also be utilized as a stand alone cup holder, for instance to serve beverages at a social or business outing. Such uses will, additionally, enhance the advertising value of printed matter on the cup holder by increasing its visibility to users and observers.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A keg cup holder for placement atop a keg container having an outer rim, said holder comprising:

a top wall member having top and bottom surfaces;

a plurality of openings within the top surface of the top wall member, each opening encircling recess means for supporting a cup, the recess means being located within the top wall member and extending from the top surface to the bottom surface of the top wall member;

side wall means for supporting the top wall member, said side wall means extending down from and substantially circumscribing the top wall member, the top wall member with the side wall means being substantially the same size as the top of the keg container;

an opening through the center of the top wall member, said opening leading to an open space beneath the top wall member and being encompassed by and within the side wall means of the keg cup holder; and support means for maintaining the keg cup holder atop the keg container, said support means being positioned directly on and extending from the bottom surface of the top wall member and immediately adjacent to the side wall means, whereby upon placement of the support means of the keg cup holder atop the keg container, the support means is pressed against the rim of the keg container to secure the keg cup holder in a fixed and stable position on the keg container.

2. The keg cup holder as in claim 1 wherein the top wall member comprises a center wall member and separate adjacent lateral wall members, the lateral wall members being rotatable from a first position wherein they are located in the same transverse plane as and are co-planar with the center wall member, to a second position wherein they are hanging perpendicularly down from the center wall member.

3. The keg cup holder as in claim 2 wherein in the second position, the lateral wall members are substantially perpendicular to the center wall member.

4. The keg cup holder as in claim 2 further comprising hinge means for connecting the center wall member to the adjacent lateral wall members and for allowing rotation of the lateral wall members between the first and second positions.

5. The keg cup holder as in claim 2 further comprising handle means for transporting the keg cup holder, the handle means extending through the opening in the center of the top wall member when the keg cup holder is in the second position.

6. The keg cup holder as in claim 1 further comprising hinge means for rotating the top wall member from a first position, wherein the top surface of the top wall member resides in a single, transverse plane, forming a completely flat, co-planar continuously extending surface, to a second position wherein the top wall member is rotated down to a collapsed mode.

7. The keg cup holder as in claim 6 wherein the top wall member comprises a separate center wall member and separate adjacent lateral wall members, said lateral wall members comprising a part of the top wall member which rotates down to said collapsed mode.

8. The keg cup holder as in claim 7 wherein the hinge means comprises dual hinges for connecting the center wall member to the lateral wall members.

9. The keg cup holder as in claim 1 wherein the support means comprises a plurality of support members.

10. The keg cup holder as in claim 1 further comprising handle means for transporting the keg cup holder.

11. A keg container and keg cup holder system comprising:

a keg container of given diameter, said keg container having an outer rim;

a keg cup holder for placement atop the keg container, said keg cup holder comprising:

a top wall member having top and bottom surfaces;

a plurality of openings within the top surface of the top wall member, each opening encircling recess means for supporting a cup, the recess means being located within the top wall member and extending from the top surface to the bottom surface of the top wall member;

side wall means for supporting the top wall member, said side wall means extending down from, adjacent to, and substantially circumscribing the top wall member, the top wall member with the side wall means being substantially the same size as the top of the keg container;

an opening through the center of the top wall member, said opening leading to an open space beneath the top wall member and the top of the keg container; and support means for maintaining the keg cup holder atop the keg container, said support means being positioned directly on and extending from the bottom surface of the top wall member and being immediately adjacent to the side wall means, whereby upon placement of the support means of the keg cup holder atop the keg container, the support means is pressed against the rim of the keg to secure the keg cup holder in a fixed and stable position on the keg container.

12. The keg container and keg cup holder system as in claim 11 wherein the top wall member comprises a center wall member and separate adjacent lateral wall members, the lateral wall members being rotatable from a first position wherein they are located in the same transverse plane as and are co-planar with the center wall member, to a second position wherein they are hanging perpendicularly down from the center wall member.

13. The keg container and keg cup holder system as in claim 12 wherein in the second position, the lateral wall members are substantially perpendicular to the center wall member.

14. The keg container and keg cup holder system as in claim 12 further comprising hinge means for connecting the center wall member to the adjacent lateral wall members and for allowing rotation of the lateral wall members between the first and second positions.

15. The keg container and keg cup holder system as in claim 11 wherein the support means comprises a plurality of support members.

16. The keg container and keg cup holder system as in claim 11 further comprising handle means for transporting the keg cup holder.

17. The keg container and keg cup holder system as in claim 16 wherein the handle means extends through the opening in the center of the top wall member when the keg cup holder is in the second position.

* * * * *